US011185181B2

(12) United States Patent
Khatchikian

(10) Patent No.: US 11,185,181 B2
(45) Date of Patent: Nov. 30, 2021

(54) METHOD AND SYSTEM FOR SECURING PACKAGES NEAR A DOOR

(71) Applicant: George Khatchikian, Cathedral City, CA (US)

(72) Inventor: George Khatchikian, Cathedral City, CA (US)

( * ) Notice: Subject to any disclaimer, the term of this patent is extended or adjusted under 35 U.S.C. 154(b) by 27 days.

(21) Appl. No.: 16/741,389

(22) Filed: Jan. 13, 2020

(65) Prior Publication Data

US 2021/0212493 A1 Jul. 15, 2021

(51) Int. Cl.

| | |
|---|---|
| ***A47G 29/14*** | (2006.01) |
| ***A47G 29/30*** | (2006.01) |
| ***A47G 29/20*** | (2006.01) |

(52) U.S. Cl.

CPC ..... *A47G 29/141* (2013.01); *A47G 29/20* (2013.01); *A47G 29/30* (2013.01); *A47G 2029/144* (2013.01); *A47G 2029/149* (2013.01)

(58) Field of Classification Search

CPC ..... A47G 29/141; A47G 29/20; A47G 29/30; A47G 29/1214; A47G 29/124; A47G 2029/144; A47G 2029/149; B65D 29/04; B65D 29/00; B65D 33/34; G07C 9/00912; E05B 65/0075

USPC ..... 232/17, 19, 45; 383/117, 42; 70/64; 109/59 R

See application file for complete search history.

(56) References Cited

U.S. PATENT DOCUMENTS

| | | | | |
|---|---|---|---|---|
| 5,492,272 | A * | 2/1996 | Fewer | A47G 29/12 232/19 |
| 6,155,715 | A * | 12/2000 | Lake | A47G 29/20 150/102 |
| 6,928,415 | B1 * | 8/2005 | Liberman | A47G 29/141 383/120 |
| 10,076,204 | B1 * | 9/2018 | Sadeghi | A47G 29/141 |
| 10,093,454 | B1 * | 10/2018 | Kalyan | A47G 29/14 |
| 10,143,320 | B1 * | 12/2018 | Batts | A47G 29/124 |
| 10,537,197 | B2 * | 1/2020 | Hopp | A47G 29/20 |
| 10,653,261 | B2 * | 5/2020 | Loures | E05B 67/383 |
| 10,786,104 | B1 * | 9/2020 | Pappas | B65D 29/04 |
| 10,842,305 | B1 * | 11/2020 | Alcolea | A47G 29/124 |
| 10,869,570 | B2 * | 12/2020 | Dunkelberger | A44B 19/30 |
| 2010/0006636 | A1 * | 1/2010 | Frankenberg | A47G 29/22 232/44 |
| 2012/0269461 | A1 * | 10/2012 | Proctor | G09F 23/00 383/64 |
| 2013/0077896 | A1 * | 3/2013 | Wiley | A47G 29/20 383/86.2 |
| 2017/0106979 | A1 * | 4/2017 | Seger | B64D 1/12 |

(Continued)

*Primary Examiner* — William L Miller

(74) *Attorney, Agent, or Firm* — Perkins Coie LLP; Colin M. Fowler

(57) ABSTRACT

The disclosed embodiments include an anti-theft system. The anti-theft system includes a netting, a male connector linkage, and a network of female connectors. The netting includes a set of safety loops along the periphery of the netting. The male connector linkage includes at least two male connectors connected by a linkage. The male connector linkage is woven through the safety loops then connected to individual female connectors within the network of female connectors. The network of female connectors is embedded within an opening on a door. The anti-theft system is operable to cling or secure a package to a door in order to prevent the theft of said package.

24 Claims, 10 Drawing Sheets

(56) References Cited

U.S. PATENT DOCUMENTS

| | | | | |
|---|---|---|---|---|
| 2018/0029760 | A1* | 2/2018 | Maser | G08B 13/06 |
| 2018/0177318 | A1* | 6/2018 | Chambers | A47G 29/30 |
| 2018/0202199 | A1* | 7/2018 | Critz | B65D 33/34 |
| 2019/0038062 | A1* | 2/2019 | Sundaresan | A47G 29/1225 |
| 2019/0133362 | A1* | 5/2019 | Gilligan | A47G 29/141 |
| 2019/0233111 | A1* | 8/2019 | High | B64D 1/12 |
| 2020/0015617 | A1* | 1/2020 | Izquierdo Gonzalez | A47G 29/20 |
| 2020/0060460 | A1* | 2/2020 | Farrar | A47G 29/141 |
| 2020/0107663 | A1* | 4/2020 | Eivaz | A47G 29/20 |
| 2020/0170434 | A1* | 6/2020 | Lemieux | A47G 29/20 |
| 2020/0388095 | A1* | 12/2020 | Agbeyo | G08B 3/10 |

* cited by examiner

METHOD AND SYSTEM FOR SECURING PACKAGES NEAR A DOOR

TECHNICAL FIELD

The disclosed teachings relate to anti-theft systems. More specifically, the disclosed teachings relate to anti-theft systems for delivered packages.

BACKGROUND

Packages are routinely stolen from people's doorsteps by thieves. Current methods for package safety are rudimentary and cannot be universally employed. For example, larger buildings, with multiple apartments or condominiums, have staff to allow delivery workers into the building and deliver packages into trusted hands. Some e-commerce companies have deployed lockers (i.e., Amazon lockers), where customers can come to a central location to pick up their packages. Other types of homes, such as single-family homes, adopt self-care techniques such as placing notices requesting a delivery worker to drop package over a fence, or to leave the package behind an obstacle.

Nevertheless, these methods merely mask the problem, rather than solving it. Statistics show that even with additional safety measures in place, e-commerce leaders estimate that approximately 1 in 4 customers have experienced package theft. The average cost of a stolen package is $140. Based on current trends of increasing e-commerce transactions, the rate of package theft is likely to continue rising.

Therefore, there is a need for a better anti-theft system for delivered packages.

BRIEF DESCRIPTION OF THE SEVERAL VIEWS OF THE DRAWINGS

The techniques introduced here may be better understood by referring to the following Detailed Description in conjunction with the accompanying drawings, in which same reference numerals indicate identical or functionally similar elements.

DETAILED DESCRIPTION

The embodiments set forth below represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. It should be understood that these concepts and applications fall within the scope of the disclosure and the accompanying claims.

The purpose of the terminology used herein is only for describing embodiments and is not intended to limit the scope of the disclosure. Where context permits, words using the singular or plural form may also include the plural or singular form, respectively.

As used herein, unless specifically stated otherwise, terms such as "processing," "computing," "calculating," "determining," "displaying," "generating," or the like, refer to actions and processes of a computer or similar electronic computing device that manipulates and transforms data represented as physical (electronic) quantities within the computer's memory or registers into other data similarly represented as physical quantities within the computer's memory, registers, or other such storage medium, transmission, or display devices.

As used herein, terms such as "connected," "coupled," or the like, refer to any connection or coupling, either direct or indirect, between two or more elements. The coupling or connection between the elements can be physical, logical, or a combination thereof.

Figure 1:
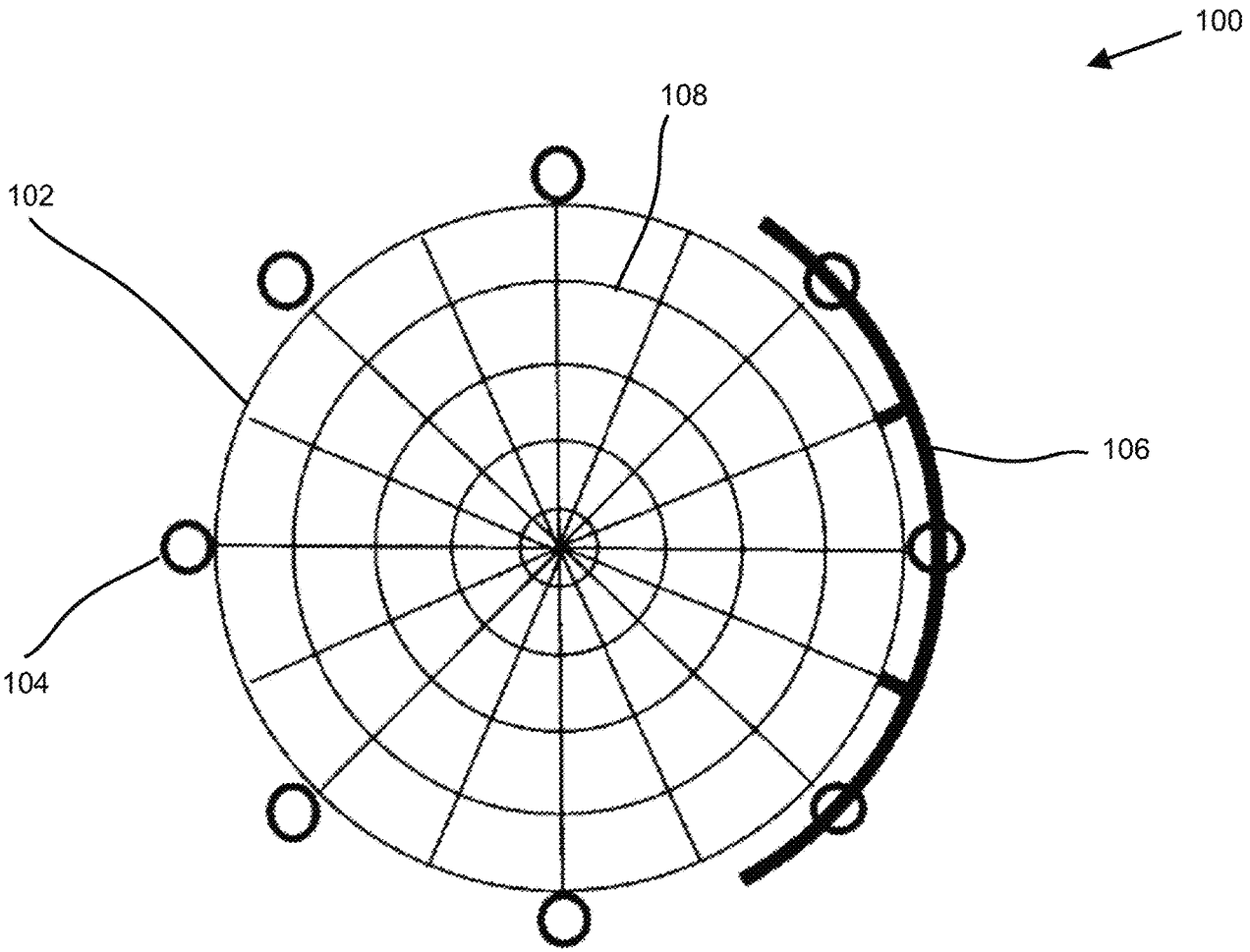
FIG. 1 illustrates an anti-theft system in accordance with one embodiment of the present disclosure.

FIG. 1 illustrates an anti-theft system in accordance with one embodiment of the present disclosure including a netting 102, safety loops 104, male connector linkage 106, and support structure 108. Netting 102 is operable to secure a package to a door by surrounding the package, at least partially. The netting 102 is made of a braided-hard metal (e.g., cut-resistant material) such as tungsten, high-alloy steel, hardened steel, braided steel, titanium, iron, and/or other similar materials. In contrast, metals such as copper, lead, pure aluminum, and tin are soft metals. However, in some embodiments, netting 102 is made of materials such as nylon, polypropylene, polyesters, polyethylene, rubber, and/or other suitable materials. Additionally, netting 102 can be various sizes. The sizes are based on the size of the package, weight of the package, the size of the door, or any other relevant factors. In some embodiments, netting 102 is made of nylon and has a radius of 20 inches. Thus, the netting 102 can secure a package that is less than twenty inches in one dimension.

In some embodiments, netting 102 is made of a stretchable material such as rubber and has a radius of ten inches. However, due to the stretchable nature of the netting 102, netting 102 may be able to secure a package that is larger than ten inches in any one dimension. For example, a netting 102 made rubber with a ten-inch radius may be able to secure a package that is thirteen inches by thirteen inches by thirteen inches, depending on the elasticity of the rubber.

In some embodiments, netting 102 is modular to allow for extensions or interchangeable parts. The netting 102 is made of multiple parts that are connected by, for example, magnets, clips, clamps, or other cinching mechanisms. A user can remove one or more pieces to increase or decrease the size of netting 102. For example, netting 102 can be made of a metal such as aluminum and have a default radius of ten inches. However, a user can interchange one or more parts to extend the radius to twelve inches. The user can interchange or add one or more pieces along the periphery of the netting to increase the circumference of netting 102. Additionally, the user can add pieces to support structure 108 to extend the radius of netting 102. Furthermore, netting 102 can be various shapes such as a circle, octagon, square, rectangle, oval, or other appropriate shape. Netting 102 can also be modified, as mentioned above, due to its possibly modular nature. For example, netting 102 can be circular in its default shape. However, if the user prefers another shape, netting 102 may be modified by adding or removing parts as needed.

In some embodiments, netting 102 is also extendable by using an extension mechanism. The extension mechanism is a part of the support structure 108 and functions to extend the size (e.g., radius) of netting 102. In some embodiments, netting 102 is made of nylon that is spooled into a housing at various points in support structure 108. The housing can have a locking mechanism that prevents the spool of nylon from retracting or unspooling more nylon unless unlocked by a user. In some embodiments, netting 102 is comprised of coiled rubber cables that can extend when stress is placed on either end of the cable.

Netting 102 also includes safety loops 104. The safety loops 104 are made of the same material or different material than netting 102 and are operable to receive male connector linkage 106. A netting 102 can have one or more safety loops 104 depending on various factors such as, for example, size of netting 102, size of a package, size of the door, shape of netting 102, weight of the package, or other relevant factors. In some embodiments, netting 102 is circular and has two safety loops 104 that are opposite each other (e.g., one hundred and eighty degrees apart). In some embodiments, netting 102 is a circle and has multiple safety loops 104, every fifteen degrees. In some embodiments, netting 102 is a square and has safety loops only near the corners.

The anti-theft system also includes male connector linkage 106, which is operable to be inserted through safety loops 104 and connected to female connectors on a door. Male connector linkage 106 includes two male connectors connected by a linkage. Male connector linkage 106 functions to lock netting 102 to a door and secure a package within netting 102.

Figure 2:
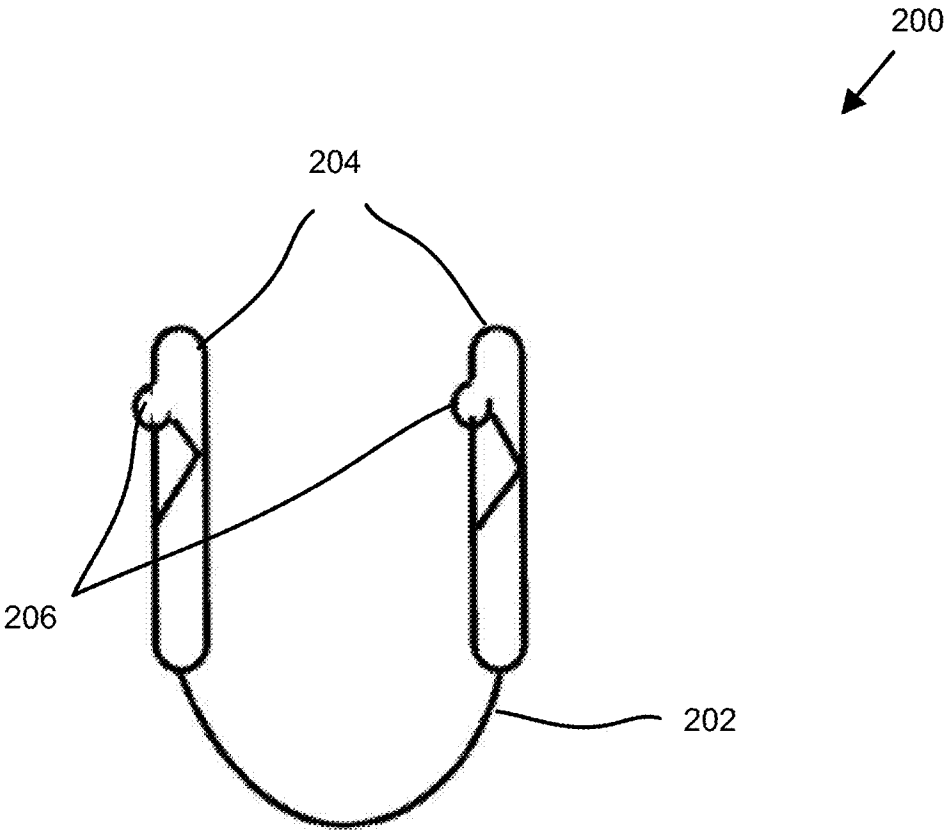
FIG. 2 illustrates a male connector system in accordance with one embodiment of the present disclosure.

FIG. 2 illustrates a male connector system in accordance with one embodiment of the present disclosure. Male connector system 200 includes linkage 202, male connectors 204, and depressible protrusions 206. Linkage 202 can be made of various materials such as nylon, polypropylene, polyesters, polyethylene, rubber, and/or any other suitable material. Additionally, linkage 202 can be flexible and/or stretchable based on the material. In one embodiment, linkage 202 is made of nylon and is four inches in length. In some embodiments, linkage 202 is made of rubber, is four inches long, and is extendable to the range allowable by the elasticity of the rubber.

Linkage 202 is coupled to male connectors 204 on both ends of linkage 202. Male connectors 204 can be made of various materials such as metal, plastics, ceramics, glass, fiberglass, concrete, or other suitable materials. In some embodiments, male connectors 204 also include depressible protrusions 206, which allow the male connectors 204 to couple to female connectors and subsequently decouple from female connectors. Male connector system 200 runs through the safety loops of a netting and connects both ends of the male connectors 204 to female connectors. In some embodiments, the female connectors are affixed to the outside-facing side of a door. A delivery worker can then approach the female connectors with a package, a netting with safety loops, and male connector system 200. The delivery worker can then place the package within the netting, insert the male connector system 200 through the safety loops, and subsequently connect the male connectors 204 to the female connectors, thereby securing the package inside the netting and near the door.

In some embodiments, the package may be too large for the netting to completely encompass. Thus, the delivery worker may have to cling the package to the outside-facing side of the door using the anti-theft system described herein. To do so, the delivery worker may temporarily hold the package near the female connectors on the outside-facing side of the door, surround a substantial portion of the package with the netting, and using multiple male connector systems 200 to cling the package to the door. For example, the delivery worker could be delivering a large rectangular box to a residence that does not fit into a netting. Thus, the delivery worker may partially encompass the package and use one male connector system 200 on each of the long sides of the rectangular box to cling the box near the door.

Figure 3:
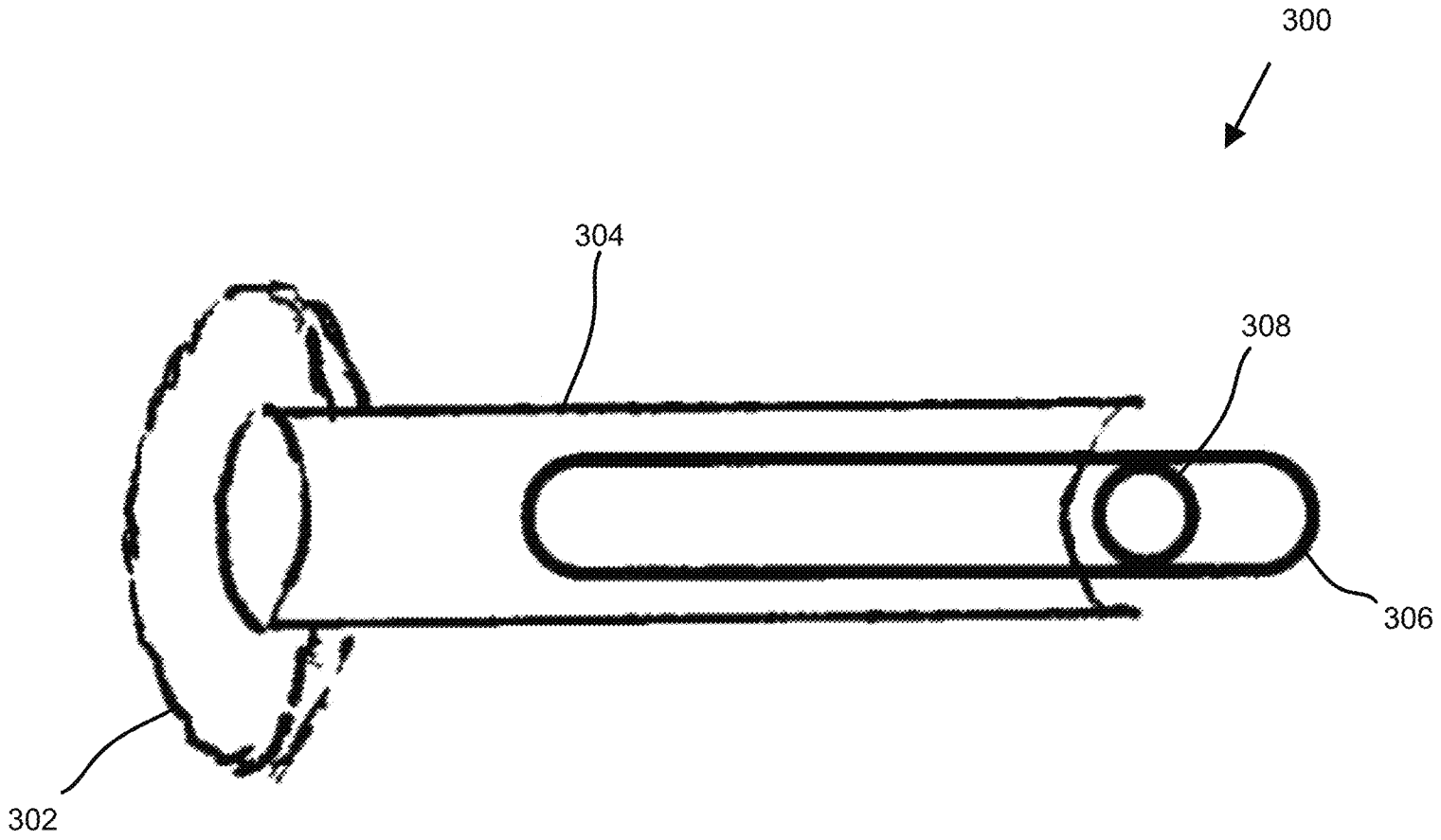
FIG. 3 illustrates an interlocking mechanism in accordance with one embodiment of the present disclosure.

FIG. 3 illustrates an interlocking mechanism in accordance with one embodiment of the present disclosure. Interlocking mechanism 300 includes opening 302, female connector 304, male connector 306, and release 308. Opening 302 is on the door where the anti-theft system is used. Opening 302 can connect the outside-facing side of the door to the inside-facing side of the door. Opening 302 also houses female connector 304, which can protrude into the interior of the residence. Female connector 304 can be attached to the opening by glue, cinching, clamps, bolts, screws, nails, or other suitable methods.

In some embodiments, opening 302 is on an external surface of a building, such as a fence, a wall, a pillar, a window, and/or other external surface(s). For example, a residence can have a compound wall surrounding the residence which prevents unauthorized visitors from entering the compound. However, the compound wall can incorporate opening 302, thereby allowing a delivery worker to deliver a package without requiring prior approval.

Generally, there are multiple ways to connect female connector 304 to opening 302. In some embodiments, female connector 304 forms an airtight seal with opening 302. In some embodiments, female connector 304 is removably attached to the opening 302. This can be advantageous when a user needs to use and interchange various types of female connectors (e.g., to match the male connector). For example, the user may switch female connectors every week in order to increase the safety of the anti-theft system. In some cases, a delivery worker may only carry a particular type of male connector. Thus, the resident or user expecting a delivery from said delivery worker, may need to switch the female connector in order to be able to receive the male connector.

Male connector 306 is similar to male connectors 204 and includes release 308. Release 308 functions to couple and decouple the male connector 306 from female connector 304. Release 308 can be in various forms, such as a depressible protrusion that clicks into an opening on female connector 304, a twist release, a grooved insert, or any other suitable method. In some embodiments, male connector 306 may be narrow on one end and gradually increase in circumference towards the opposite end. Thus, when male connector 306 is inserted into female connector 304, male connector 306 may become interlocked when the circumference of the female connector becomes smaller than the circumference of the male connector. In some embodiments, female connector 304 can have grooves that align with the grooves of male connector 306, thereby tightening its grasp as the male connector 306 is twisted into place.

Figure 4:
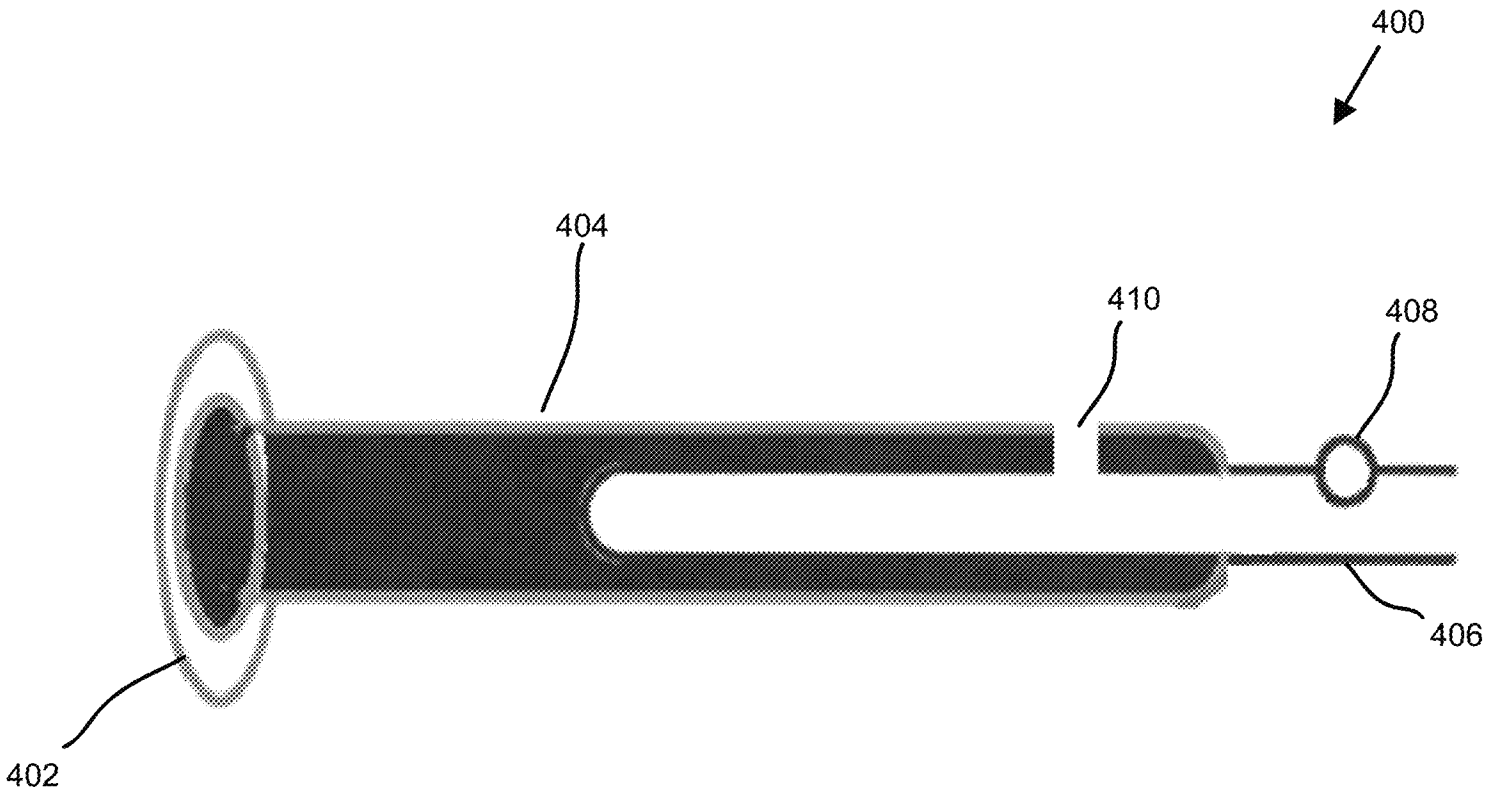
FIG. 4 illustrates a push release interlocking mechanism in accordance with one embodiment of the present disclosure.

FIG. 4 illustrates a release interlocking mechanism in accordance with one embodiment of the present disclosure. Release interlocking mechanism 400 includes opening 402, female connector 404, and male connector 406, which function similar to the corresponding elements described above, in conjunction with FIG. 3. FIG. 4 also includes release 408 and locking gap 410. As shown, release 308 is a depressible protrusion within male connector 406. A user can depress release 408 then slide male connector 406 into female connector 404. Locking gap 410 will allow release 408 to snap into the gap once male connector 406 is in a position such that release 408 is below locking gap 410. Once release 408 snaps into locking gap 410, the male connector 406 is locked into place. A user can then depress release 408 through locking gap 410 to decouple male connector 406 from female connector 404.

In some embodiments, a user may be alerted to having received a package that is secured to the outside-facing side of the door using the anti-theft mechanism described herein. The user may then approach the inside-facing side of the door, depress the release 408 within locking gap 410, and slide the female connector 404 away from male connector 406 or push male connector 406 away from female connector 404, thereby releasing the netting from the door and retrieving the package.

Figure 5:
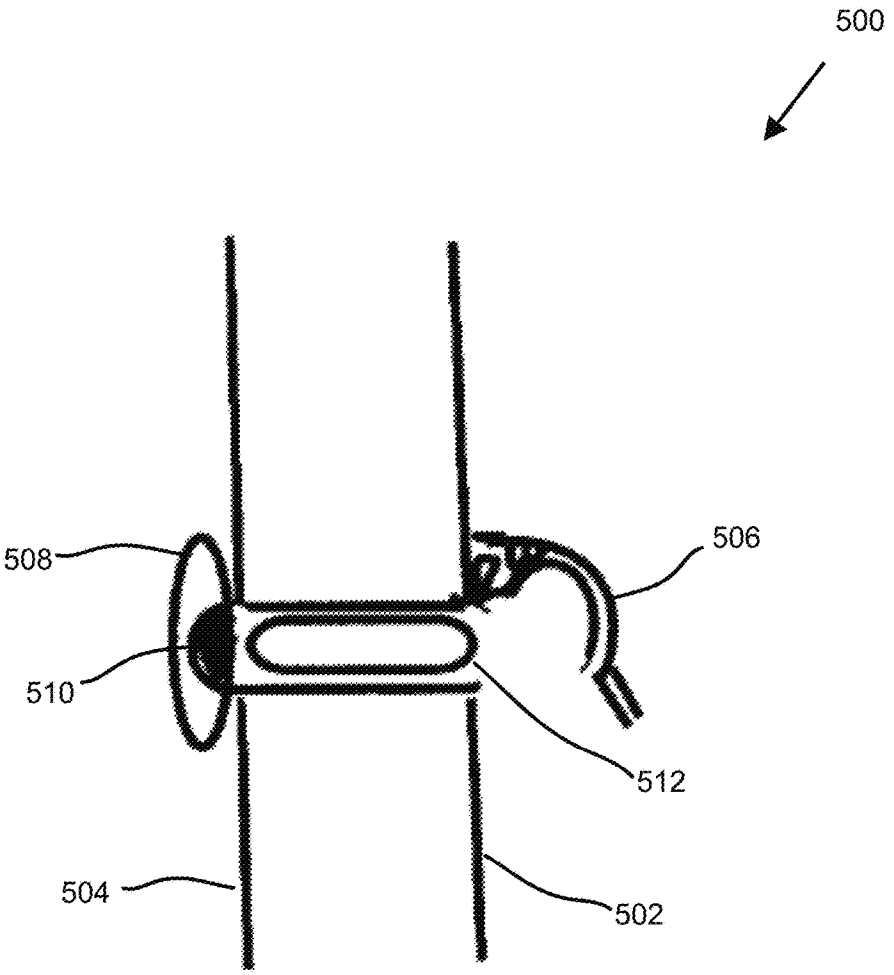
FIG. 5 illustrates an interlocking system, an opening in a door, in accordance with one embodiment of the present disclosure.

FIG. 5 illustrates an interlocking system within an opening in a door in accordance with one embodiment of the present disclosure. An interlocking system within an opening in a door 500 includes outside of a door 502, inside of a door 504, outside cap 506, inside opening 508, inside push release 510, and male connector 512. Outside of a door 502 is where a delivery is made by a delivery service employee, worker, or other applicable representative. Inside of a door 504 faces the interior of the residence where the customer resides. The inside opening 508, inside push release 510, and male connector 512 function similarly to the corresponding elements described above in conjunction with FIGS. 3 and 4.

Outside cap 506 can function as a cover such that the interior of the residence cannot be seen from the outside of the residence, and/or particles from outside the residence do not enter the inside of the residence. The outside cap 506 can be made of various materials such as metal, rubber, plastic, glass, fiberglass, or any other suitable material. Outside of a door 502 and outside cap 506 can couple to each other using mechanisms such as clamps, magnets, glues, cinches, fastening mechanisms, or other appropriate mechanism(s). Additionally, based on the coupling mechanism, there can be an airtight seal between outside cap 506 and outside of a door 502. For example, outside cap 506 can adhere to outside of a door 502 using magnets. Outside cap 506 can have magnets along its periphery that are attracted to magnets on outside of a door 502 that are placed to receive the magnets on outside cap 506.

In some embodiments, outside cap 506 can have a spring mechanism that clamps against outside of a door 502 unless a force is exerted. The force required to detach outside cap 506 from outside of a door 502 can depend on the material on the spring, the size of the outside cap 506, spring constant based on Hooke's law, and other relevant factors. For example, a resident that is installing the anti-theft mechanism may chose various springs based on the conditions of the surroundings. If the user lives in a windy region, the spring constant (e.g., strength of the spring) may have to be higher so as to stop the outside cap 506 from opening on windy days. Alternatively, a customer that lives in a rural area may be more concerned with small animals or bugs entering the residence. Thus, the customer may opt to use magnets to cinch the outside cap 506 to the outside of a door 502, with a small or no gap in between.

Figure 6:
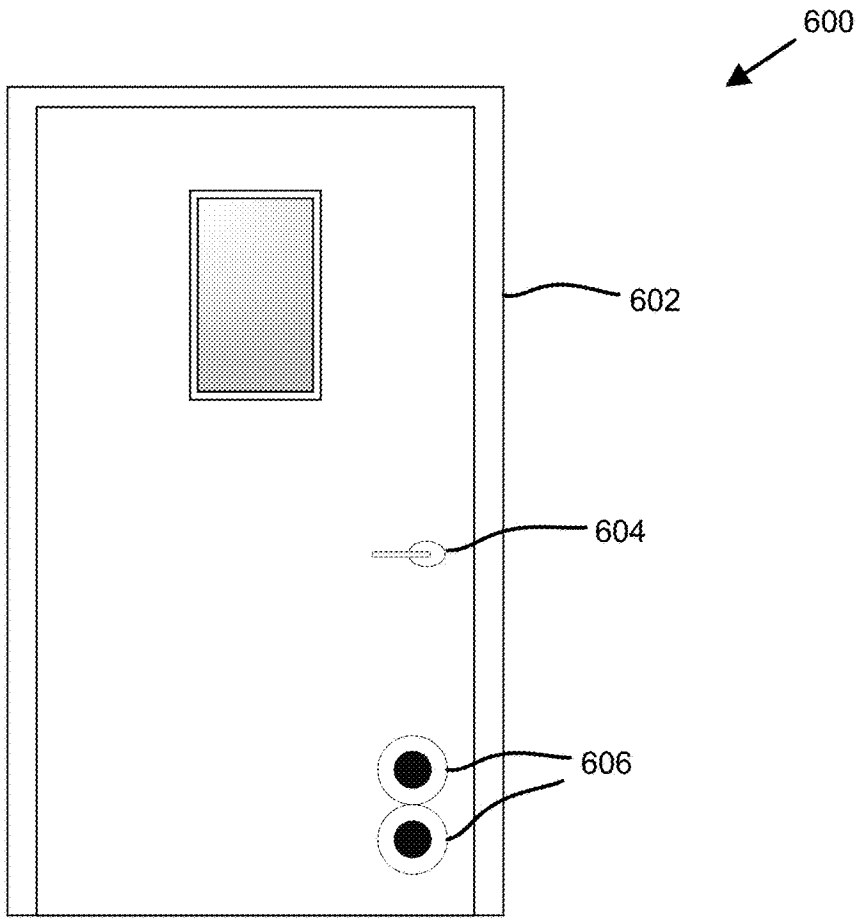
FIG. 6 illustrates a macro view of the inside of a door with the anti-theft device, in accordance with one embodiment of the present disclosure.

FIG. 6 illustrates a macro view of the inside of a door with the anti-theft device in accordance with one embodiment of the present disclosure. The macro view of the inside of a door with the anti-theft device 600 includes inside of door 602, door knob 604, and inside push release buttons 606. Inside of door 602 faces the interior of the residence where the customer or person awaiting a package resides. Inside push release buttons 606 function similarly to the releases described above in conjunction with FIGS. 3 and 4.

In some embodiments, there are multiple (e.g., more than two) inside push release buttons 606 on inside of door 602. Generally, a delivery worker can use as many openings (e.g., with female connectors) as needed to sufficiently secure a package against a door. For example, when a package is larger than the size of the netting and the delivery worker cannot encompass the package within the netting, the delivery worker may have to cling the package to the door. A delivery worker can do this, as described above, by placing the package against the door near the one or more openings with female connectors, placing the netting substantially around the package, and connecting the multiple male connectors to the corresponding female connectors. Thus, the customer may have to use multiple inside push release buttons 606 to retrieve a package.

Optionally, as shown in FIG. 6, there are two inside push release buttons 606 adjacent to each other. In some embodiments, the netting can encompass the package (e.g., similar to a bag), the male connector linkage is inserted through all the safety loops on the netting, and each end of the male connector linkage would couple to one of the two female connectors. In some embodiments, multiple inside push release buttons 606 are placed sporadically around a door, thereby allowing a delivery worker to choose how to sufficiently secure a package to a door.

Figure 7:
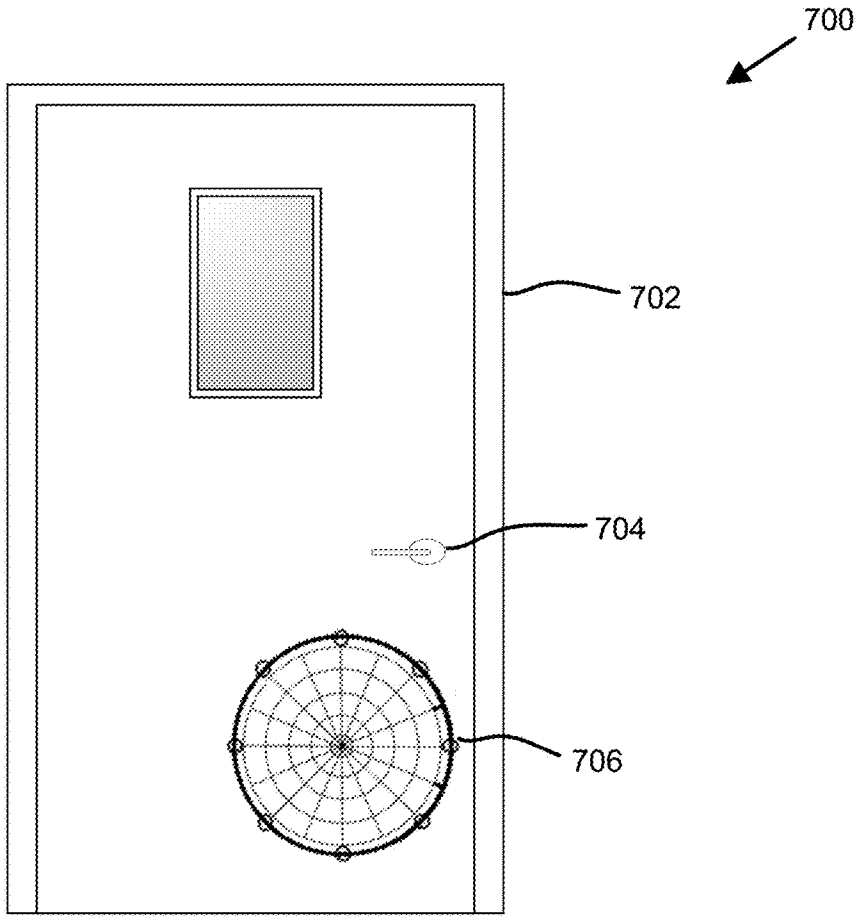
FIG. 7 illustrates a macro view of outside of a door with the anti-theft device, in accordance with one embodiment of the present disclosure.

FIG. 7 illustrates a macro view of outside of a door with the anti-theft device in accordance with one embodiment of the present disclosure. Macro view of outside of a door with the anti-theft device 700 includes outside of a door 702, door knob 704, and anti-theft device 706. The outside of a door 702 faces the exterior of a house, where a delivery worker can deliver a package. Anti-theft device 706, as shown here, is clinging to outside of a door 702. In some embodiments, anti-theft device 706 can have multiple (e.g., more than two) male connectors coupled to multiple female connectors on outside of a door 702. Optionally, anti-theft device 706 can have a pair of male connectors coupled to a pair of female connectors on outside of a door 702. The female connectors can be adjacent or not adjacent to each other.

Figure 8:
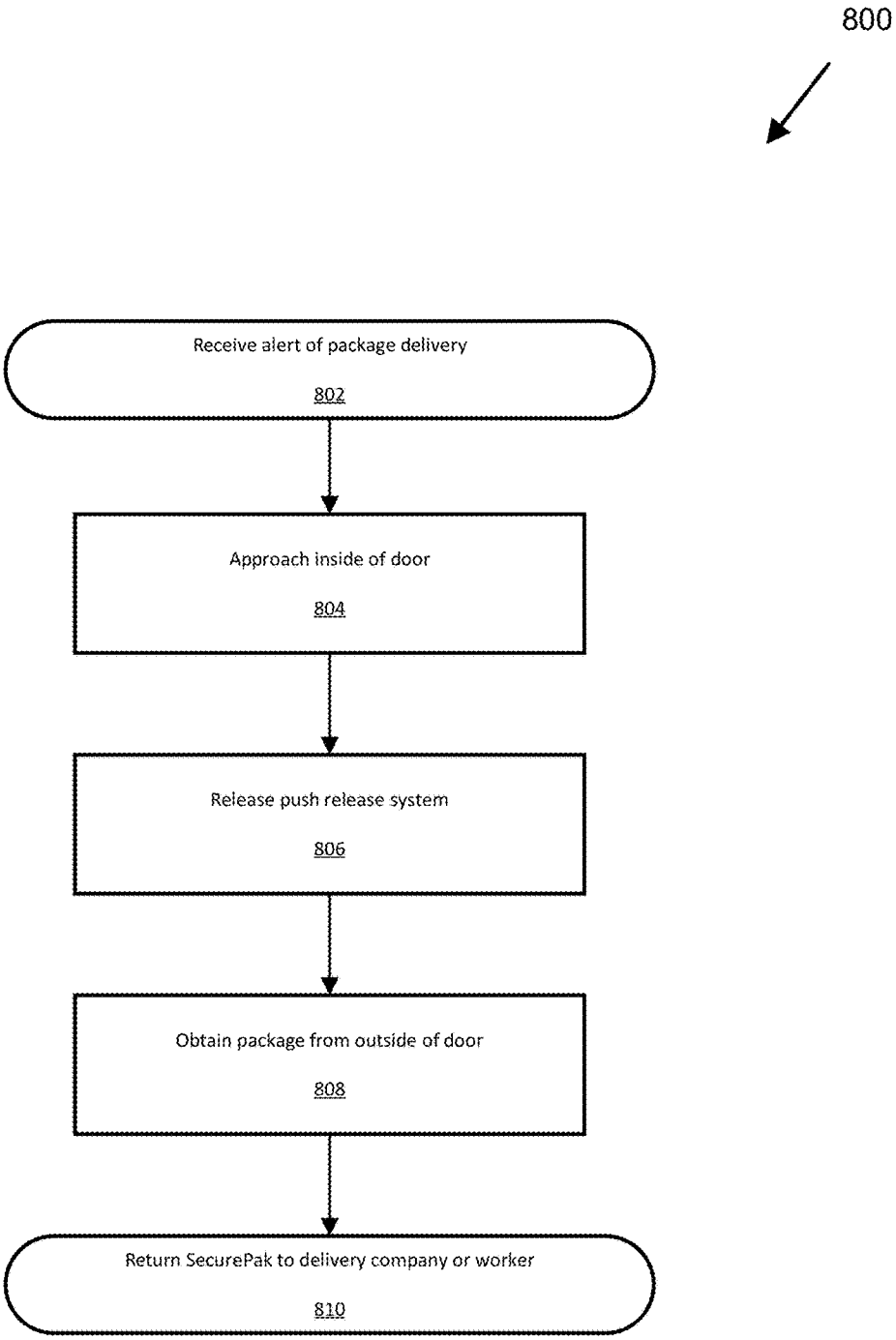
FIG. 8 illustrates a method from the perspective of a customer, in accordance with one embodiment of the present disclosure.

FIG. 8 illustrates a method from the perspective of a customer in accordance with one embodiment of the present disclosure. The method in FIG. 8 includes receive alert of package delivery 802, approach inside of door 804, release push release system 806, obtain package from outside of door 808, and return anti-theft device to delivery company or worker 810. A customer is any person expecting a package, a resident of the residence to which a package was delivered, or other appropriate person.

A customer can receive alert of package delivery 802 in various ways. For example, the delivery worker may ring the doorbell or knock, the delivery service may automatically send the customer an email, text message, or other appropriate forms of communication, the customer may have a motion senor or camera directed towards the door, etc. In some embodiments, the anti-theft system may include a buzzer (e.g., similar to a doorbell) to alert the customer. Thus, when the delivery worker completes using the anti-theft device, the delivery worker can then use the buzzer. The buzzer can be a button placed in an appropriate location on the anti-theft device, such as near the female connector(s) on the door.

Optionally, the anti-theft device may automatically alert a customer when the female connectors are used. For example, the anti-theft device may have an onboard processor with communication capabilities (e.g., WiFi, Bluetooth, near-field-communication, or other known communication methods). For example, a customer may establish a Bluetooth communication channel with an onboard processor on the anti-theft system. The system may be programmed to send an alert to the user, via the established Bluetooth communication channel, when the system detects that the female connectors are being used.

Upon receiving the alert, the user can approach inside of door 804 to release push release system 806. The user may be able to release the push release system in multiple ways (e.g., by depressing a depressible protrusion, twisting, etc., as described above). Furthermore, the user may be able to release the push release based on an established communication channel between a user's device and the anti-theft device. For example, a user's smartphone may emit a radio-frequency identification (RFID) that the anti-theft device may be configured to receive. Upon receipt of the signal, the system may release the male connectors from the female connectors. Optionally, the anti-theft system may require a code-matching system, where the anti-theft system has a random number generator that communicates a combination of numbers to a paired device (e.g., the user's device). The user can then type said combination of numbers into a portal (e.g., on the anti-theft device or on the user's smart device) to decouple the male connectors from the female connectors.

In some embodiments, the anti-theft system may have a smart application-based portal on a user's smart device. For example, the application may require a user to log in using a password before being able to access the package. The portal may have multiple phases, such as, for example, requiring a password, identifying a particular anti-theft device, and unlocking the device. In some embodiments, the anti-theft device may be trained to recognize the user's voice. For example, through an initial training phase on a smart device application, the user may record their voice. The data from the recording can then be stored on the anti-theft (e.g., having onboard memory) or in a remote server. Thus, when the user speaks, the device may unlock. Optionally, the anti-theft may only unlock if a certain phrase is used (e.g., "please unlock," etc.)

Figure 9:
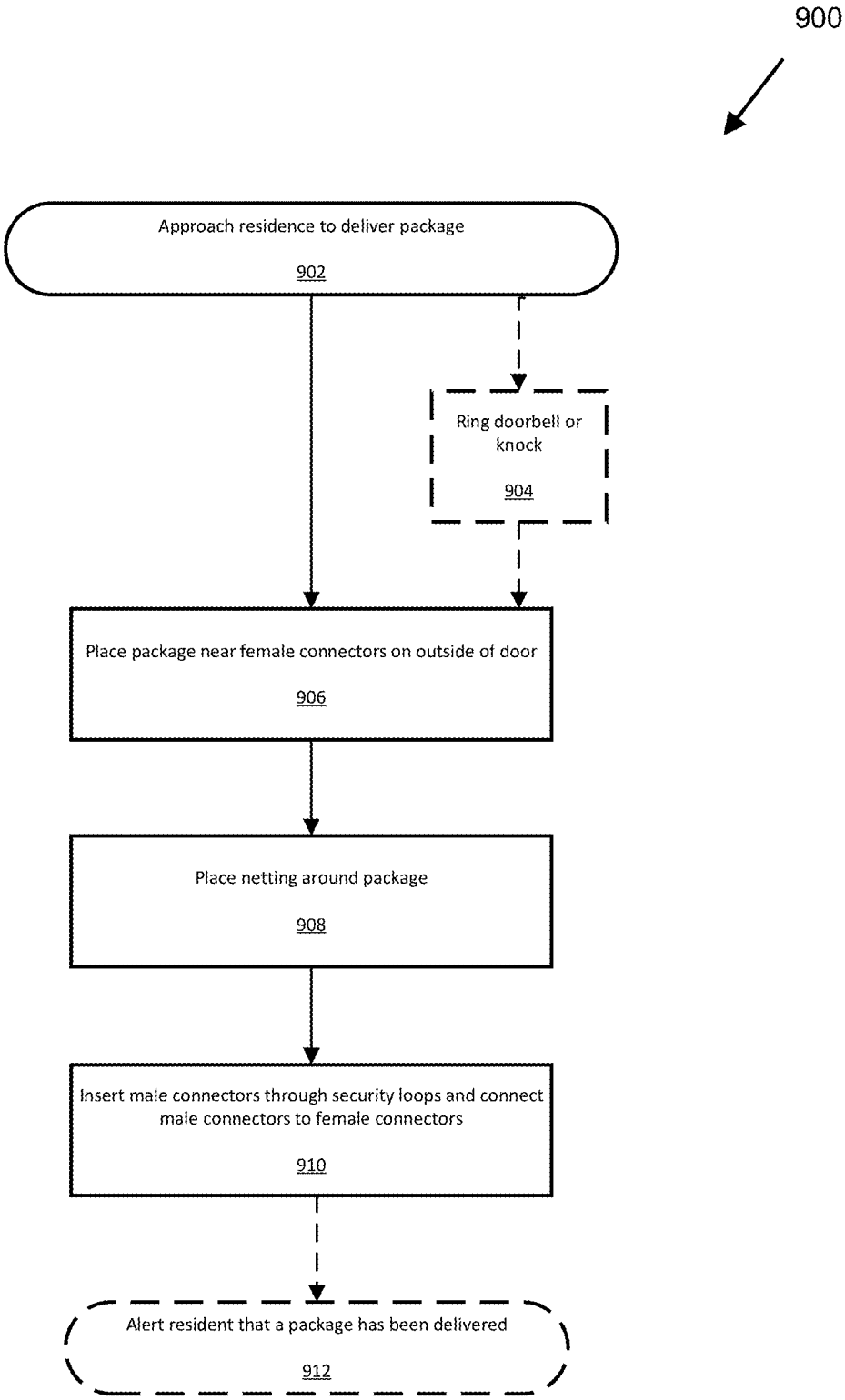
FIG. 9 illustrates a method from the perspective of a delivery worker, in accordance with one embodiment of the present disclosure.

FIG. 9 illustrates a method from the perspective of a delivery worker in accordance with one embodiment of the present disclosure. The method in FIG. 9 includes approach residence to deliver package 902, place package near female connectors on outside of door 906, place netting around package 908, and insert male connectors through security loops and connect male connectors to female connectors 910. The method optionally includes ring doorbell or knock 904 and alert resident that a package has been delivered 912.

Generally, a delivery worker is a representative (e.g., human, robot, etc.) of a delivery service, company, or other comparable entity. A delivery worker can approach a residence to deliver package 902 when, for example, a package is addressed to a particular residence. The delivery worker can then, optionally, decide to ring doorbell or knock 904. Alternatively, the delivery worker can proceed to use the anti-theft device by placing the package near female connectors on outside of door 906.

In some embodiments, as discussed above, the delivery worker can place the package in the netting (e.g., if the package is small enough). The delivery can then insert male connectors through security loops and connect male connectors to female connectors 910. Lastly, the delivery worker can optionally decide to alert a resident that a package has been delivered 912. As discussed above, the anti-theft system may be able to automatically alert the customer through WiFi, Bluetooth, ethernet, or other similar methods.

In some embodiments, the female connectors may not be open until a verification process is complete. The verification process is completed through, for example, a smartphone application, an established communications channel (e.g., WiFi, Bluetooth, ethernet, etc.), by inputting a verification code, a physical key, or other similar security measures. In some embodiments, the delivery worker may need to use a smart application portal in order to use the anti-theft device. The smart application portal may ask the delivery worker to identify themselves (e.g., name, employee ID, etc.) before allowing them to use the anti-theft use.

Furthermore, a delivery worker may need to carry multiple nettings (e.g., to accommodate for packages of various sizes, weights, and shapes), and may need to carry multiple male connectors (e.g., to be compatible with various female connectors). In some embodiments, a residence is assigned a unique configuration of anti-theft system. For example, a residence can have an anti-theft device with a particular type of female connector, unique combination of types of female connectors, a unique passcode, or other similar mechanism.

Figure 10:
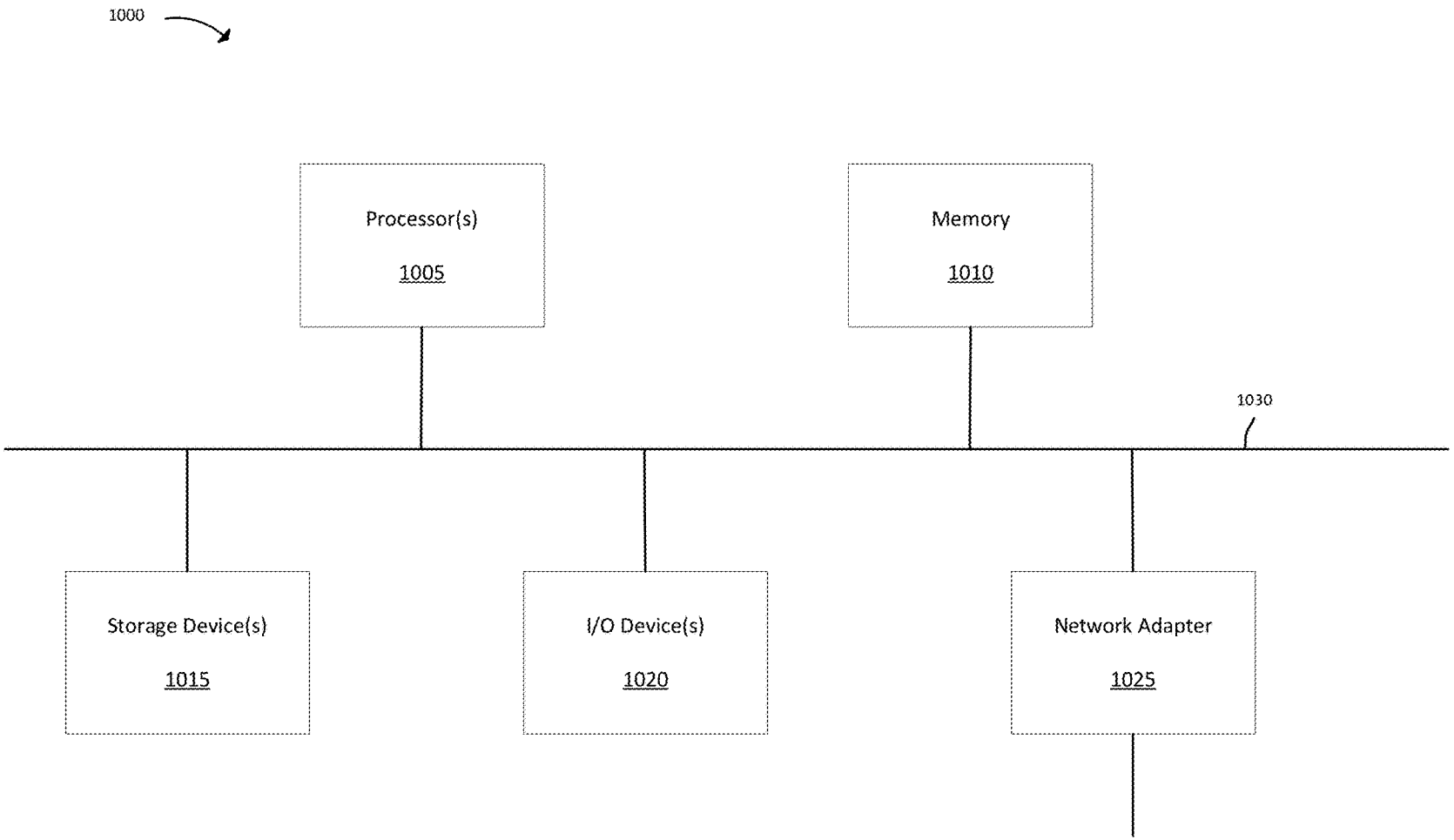
FIG. 10 is a block diagram illustrating a diagrammatic representation of a machine in the example form, on a computer system operable to perform aspects of the disclosed technology.

FIG. 10 is a block diagram of a computer system that may be used to implement features of some of the disclosed technology. The computing system 1000 may be a modular anti-theft device, an anti-theft system, a server computer, a client computer, a personal computer (PC), a user device, a tablet PC, a laptop computer, a personal digital assistant (PDA), a cellular telephone, an iPhone, an iPad, a Blackberry, a processor, a telephone, a web appliance, a network router, switch or bridge, a console, a handheld console, a (handheld) gaming device, a music player, any portable, mobile handheld device, wearable device, or any machine capable of executing a set of instructions, sequential or otherwise, that specify actions to be taken by that machine.

The computing system 1000 may include one or more central processing units (processors) 1002, memory 1004, input/output devices 1006 (e.g., keyboard and pointing devices, touch devices, display devices), storage devices 1008 (e.g., disk drives), and network adapters 1010 (e.g., network interfaces) that are each connected to an interconnect 1012. The interconnect 1012 is illustrated as an abstraction that represents any one or more separate physical buses, point to point connections, or both connected by appropriate bridges, adapters, or controllers. The interconnect 1012, therefore, may include, for example, a system bus, a peripheral component interconnect (PCI) bus or PCI-Express bus, a HyperTransport or industry standard architecture (ISA)

bus, a small computer system interface (SCSI) bus, a universal serial bus (USB), TIC (I2C) bus, or an Institute of Electrical and Electronics Engineers (IEEE) standard 1394 bus (i.e., Firewire).

The memory 1004 and storage devices 1008 are computer-readable storage media that may store instructions that implement at least portions of the various embodiments. In addition, the data structures and message structures may be stored or transmitted via a data transmission medium (e.g., a signal on a communications link). Various communications links may be used (e.g., the Internet, a local area network, a wide area network, or a point-to-point dial-up connection). Thus, computer readable media can include computer readable storage media (e.g., non-transitory media) and computer readable transmission media.

The instructions stored in memory 1004 can be implemented as software and/or firmware to program the processor 1002 to carry out actions described above. In some embodiments, such software or firmware may be initially provided to the computing system 1000 by downloading said software or firmware from a remote system through the computing system 1000 (e.g., via network adapter 1010).

The various embodiments introduced herein can be implemented by, for example, programmable circuitry (e.g., one or more microprocessors programmed with software and/or firmware), or entirely in special-purpose hardwired circuitry (i.e., non-programmable circuitry), or in a combination of such forms. Special-purpose hardwired circuitry may be in the form of, for example, one or more application-specific integrated circuits (ASICs), programmable logic devices (PLDs), field-programmable gate array (FPGAs), etc.

The above description and drawings are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

Reference herein to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example, using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any term discussed herein, is illustrative only, and is not intended to further limit the scope and meaning of the disclosure or of any exemplified term. Likewise, the disclosure is not limited to the various embodiments given in this specification.

Without intent to further limit the scope of the disclosure, examples of instruments, apparatus, methods and their related results according to the embodiments of the present disclosure are given above. Note that titles or subtitles may be used in the examples for convenience of a reader, which in no way should limit the scope of the disclosure. Unless otherwise defined, all technical and scientific terms used herein have the same meanings as commonly understood by one of ordinary skill in the art to which this disclosure pertains. In the case of conflict, the present document, including definitions, will control.

From the foregoing, it will be appreciated that specific embodiments of the invention have been described herein for purposes of illustration, but that various modifications may be made without deviating from the scope of the invention. Accordingly, the invention is not limited, except as by the appended claims.

What is claimed is:

1. An anti-theft system comprising:

a netting including a set of safety loops along a periphery of the netting;

a male connector linkage woven through a first safety loop of the set of safety loops, the male connector linkage including a first male connector and a second male connector, wherein the first male connector is positioned at a first end of the male connector linkage and the second male connector is positioned at a second end of the male connector linkage; and a network of female connectors operable to interlock with one of the male connectors in the male connector linkage, wherein at least one female connector within the network of female connectors is embedded within an external structure that receives package deliveries.

2. The anti-theft system of claim 1, wherein the first male connector and the second male connector have a depressible protrusion.

3. The anti-theft system of claim 2, wherein each female connector within the network of female connectors has a gap to receive the depressible protrusion.

4. The anti-theft system of claim 1, wherein the first male connector and the second male connector are made of metal, plastic, ceramic, glass, fiberglass, concrete, or any combination thereof.

5. The anti-theft system of claim 1, wherein the linkage is four inches long.

6. The anti-theft system of claim 1, wherein at least one female connector within the network of female connectors is embedded within a cavity in the external structure, wherein the cavity is covered by a removable cap, and wherein the removable cap comprises a coupling mechanism configured to affix the removable cap to the external structure.

7. The anti-theft system of claim 6, wherein the coupling mechanism comprises any of a magnet, spring, clamp, glue, or fastener.

8. The anti-theft system of claim 1, wherein the network of female connectors comprises at least two female connectors.

9. The anti-theft system of claim 1, wherein the anti-theft system further comprises:

a push release system operable to detach the male connector linkage from the network of female connectors.

10. The anti-theft system of claim 1, wherein the set of safety loops comprises at least two safety loops.

11. The anti-theft system of claim 10, wherein the two safety loops are opposite each other.

12. The anti-theft system of claim 1, wherein the anti-theft system further comprises:

a processor communicatively coupled to the network of female connectors, the processor operable to process data indicative of contact between at least one female connector within the network of female connectors and at least one male connector within the male connector linkage and establish a communication channel.

13. The anti-theft system of claim 12, wherein the communication channel can be based on wireless networking technology, ethernet, machine-to-machine wireless communication protocols, near-field-communications, or any combination thereof.

14. A method comprising:

receiving, by a netting, a package, wherein the netting includes a set of safety loops along a periphery of the netting;

receiving by the set of safety loops a male connector linkage, the male connector linkage including a first male connector and a second male connector, wherein the first male connector is positioned at a first end of the male connector linkage and the second male connector is positioned at a second end of the male connector linkage; and interlocking by each female connector within a network of female connectors with one of the male connectors in the male connector linkage, wherein at least one female connector within the network of female connectors is embedded within an external structure that receives package deliveries.

15. The method of claim 14, wherein said interlocking further comprises:

receiving by a gap within each female connector within the network of female connectors a depressible protrusion, wherein the depressible protrusion is a part of each of the male connectors in the male connector linkage.

16. The method of claim 14, wherein said receiving by a netting further comprises:

at least partially encompassing the package by the netting.

17. The method of claim 14, wherein said receiving by the set of safety loops further comprises:

receiving by at least two of the safety loops within the set of safety loops the male connector linkage.

18. The method of claim 14, wherein said interlocking further comprises:

engaging the first male connector with a first female connector within the network of female connectors;

engaging the second male connector with a second female connector within the network of female connectors, wherein the first female connector and the second female connector are opposite each other.

19. An anti-theft system comprising:

a netting including two or more safety loops along a periphery of the netting, wherein the netting is made of braided-hard metal;

a male connector linkage woven through the two or more safety loops, the male connector linkage including a first male connector and a second male connector, wherein the first male connector is positioned at a first end of the male connector linkage and the second male connector is positioned at a second end of the male connector linkage; and the two or more female connectors operable to interlock with the two male connectors in the male connector linkage, wherein each female connector is embedded within an external structure that receives package deliveries, and wherein each female connector has a gap to receive a depressible protrusion from each male connector.

20. The anti-theft system of claim 19, wherein the anti-theft system further comprises:

a buzzer operable to emit sound when the depressible protrusion is received by the gap within each female connector.

21. The anti-theft system of claim 19, wherein the anti-theft system further comprises:

a processor communicatively coupled to the two or more female connectors, the processor operable to process data indicative of contact between at least one female connector within the two or more female connectors and at least one male connector within the male connector linkage and establish a communication channel.

22. The anti-theft system of claim 21, wherein the communication channel can be based on wireless networking technology, ethernet, machine-to-machine wireless communication protocols, near-field-communications, or any combination thereof.

23. The anti-theft system of claim 19, wherein the first male connector and the second male connector are made of metal, plastic, ceramic, glass, fiberglass, concrete, or any combination thereof.

24. The anti-theft system of claim 19, wherein at least two safety loops within the two or more safety loops are opposite each other.

* * * * *